US007802458B2

(12) United States Patent
Möller et al.

(10) Patent No.: US 7,802,458 B2
(45) Date of Patent: Sep. 28, 2010

(54) PROCESS FOR FABRICATING LARGE-SURFACE METAL PLATE INTO A SHAPED PART, SUCH AS AN OUTER SKIN PANEL OF A VEHICLE BODY

(75) Inventors: Karl-Heinz Möller, Wiehl (DE); Stefan Schwarz, Lunen (DE)

(73) Assignee: ThyssenKrupp Steel AG, Duisburg (DE)

( * ) Notice: Subject to any disclaimer, the term of this patent is extended or adjusted under 35 U.S.C. 154(b) by 480 days.

(21) Appl. No.: 11/718,881

(22) PCT Filed: Nov. 4, 2005

(86) PCT No.: PCT/EP2005/011811

§ 371 (c)(1),
(2), (4) Date: Dec. 17, 2007

(87) PCT Pub. No.: WO2006/048302

PCT Pub. Date: May 11, 2006

(65) Prior Publication Data

US 2008/0202184 A1 Aug. 28, 2008

(30) Foreign Application Priority Data

Nov. 8, 2004 (DE) ..... 10 2004 054 120

(51) Int. Cl.
*B21D 22/10* (2006.01)

(52) U.S. Cl. ..... 72/57; 72/60; 29/421.1

(58) Field of Classification Search ..... 72/56, 72/57, 58, 59, 60, 62; 29/421.1
See application file for complete search history.

(56) References Cited

U.S. PATENT DOCUMENTS

| | | | | |
|---|---|---|---|---|
| 3,208,255 | A * | 9/1965 | Burk | 72/57 |
| 6,519,992 | B1 * | 2/2003 | Schnupp | 72/57 |
| 6,675,620 | B1 * | 1/2004 | Heyll et al. | 72/57 |
| 6,708,543 | B2 * | 3/2004 | Yoshioka et al. | 72/57 |
| 7,150,170 | B2 * | 12/2006 | Streubel et al. | 72/57 |

FOREIGN PATENT DOCUMENTS

| | | |
|---|---|---|
| DE | 19717953 | 10/1998 |
| EP | 1147833 | 10/2001 |

* cited by examiner

*Primary Examiner*—David B Jones
(74) *Attorney, Agent, or Firm*—Proskauer Rose LLP

(57) ABSTRACT

A process for forming a large-surface metal plate into a shaped part includes using a molding tool. The tool includes a reservoir filled with incompressible fluid work medium, clamping jaws and a shaping die movable towards the reservoir. Profiling elements, corresponding to each other, are configured in the interior of the reservoir and on the outer edge of the shaping die. The external high pressure punching by means of the shaping die moved forward against the high pressure of the fluid work medium is ended, when the shaping die has reached the profiling elements in the reservoir, by the pressure of the fluid work medium in the reservoir being reduced. The boundary sections of the metal plate are then formed between the profiling elements, pressed against each other, of the shaping die and the reservoir, at low pressure of the fluid work medium or at zero pressure.

5 Claims, 4 Drawing Sheets

PROCESS FOR FABRICATING LARGE-SURFACE METAL PLATE INTO A SHAPED PART, SUCH AS AN OUTER SKIN PANEL OF A VEHICLE BODY

CROSS-REFERENCE TO RELATED APPLICATIONS

This application is a National Phase Application of International Application No. PCT/EP05/11811, filed on Nov. 4, 2005, which claims the benefit of an priority to German Patent Application No. 10 2004 054 120.5 filed Nov. 8, 2004. The disclosures of the above applications are incorporated herein by reference in their entirety.

FIELD OF THE INVENTION

The invention relates to a process for forming a large-surface metal plate into a shaped part, such as an outer skin panel of a vehicle body, which has a central section formed comparatively moderately by external high pressure punching and a boundary section, formed comparatively strongly by pressing, using a molding tool, which comprises a reservoir filled with incompressible fluid work medium having profiling elements arranged therein for the boundary section of the metal plate, clamping jaws for tight clamping of the metal plate in its outside boundary section at the edge of the reservoir and a shaping die movable towards the reservoir, at whose outer edge are configured profiling elements corresponding to the profiling elements of the reservoir.

BACKGROUND OF THE INVENTION

With such a forming process the exterior of the plate in the region of the central section to be formed is treated extremely carefully, because only this exterior, forming the visible side, comes into contact with the incompressible fluid work medium. This can be important for the visual appearance of a vehicle body. The shaped part keeps the desired precision since the shaping die contacts the metal plate directly on its non-visible rear side. In the case of a large-surface metal plate with weak curvature in its central section in order to obtain greater resistance to buckling and rigidity with minimum stress in the boundary section, it is also known to actively pre-arch the plate before the actual external high pressure punching, in particular against the subsequent drawing direction during the external high pressure punching (DE 197 17 953 A). As a result of stretching the material in the central section, generally accompanying it, higher degrees of elongation and a desired tensile strength can be achieved. While forming in the region of the central section of the metal plate is not problematic, it is comparatively difficult in the region of the outer edge because of the forming taking place in the region of the outer edge. Therefore, it is possible to obtain the large strain rates necessary in the region of the outer edge by pressing between profiling elements. Provided that the metal plate is made from a highly deep-draw capable material, the process can be carried out without difficulty. The trend with vehicle bodies, however, is moving towards high-strength steel (e.g., dual phase steel), in order to improve the crash behavior of vehicle bodies. Metal plates made from high-strength steel cannot be formed using the process described above without difficulty. Experience has shown that the metal plate tears in the boundary sections, where forming takes place by pressing between the profiling elements of the reservoir and the corresponding profiling elements of the shaping die.

With a further process for forming a large-surface metal plate into a shaped part of the type described in EP 1 147 833 A2 described above, the molding tool used has profiling dies arranged in its reservoir, which are arranged spread over the entire area and not just at the edge of the reservoir. Right from the start of forming, this process can work with low work fluid medium pressure, and thus even when the metal plate is contacted on the one side by the shaping die and on the other side only by the work fluid medium pressure. This work fluid medium pressure also remains constant if the forming process has progressed as far as the profiling elements of the reservoir and the shaped part is then pressed between these elements and the corresponding profiling elements of the shaping die. This means that during this phase the fluid work medium pressure is superimposed over the stamping pressure, which may lead to local overload on the material of the metal plate.

SUMMARY OF THE INVENTION

One aspect of the invention is to create a process that allows the possibility of using high-strength steel for a metal plate, which is to be formed into shaped parts, such as outer skin panels of a vehicle body. This aspect is achieved with a process of the kind described initially in that the external high pressure punching by means of the shaping die moved forward against the high pressure of the fluid work medium is ended when the shaping die reaches the profiling elements in the reservoir, by the pressure of the fluid work medium in the reservoir being reduced and in that the boundary sections of the metal plate are then formed between the profiling elements, pressed against each other, of the shaping die and the reservoir, at low pressure of the fluid work medium or at zero pressure. The process according to the invention is advantageous, particularly if large production quantities are not required.

With the process according to the invention, a metal plate made from high-strength steel can be formed without difficulty, because the pressing of the boundary sections between the profiling elements is still not being superimposed over the drawing during external high pressure punching of the central section with the boundary sections, but drawing is practically ended before the boundary sections are pressed.

When the boundary sections of the plate are formed between the profiling elements pressed against each other, clamping of the boundary sections of the metal plate can be relaxed so that material can re-flow towards the profiling elements.

It can be advantageous with external high pressure punching if the material is pre-stretched. According to one embodiment of the invention during external high pressure punching, the clamped metal plate can be pre-stretched before the external high pressure punching by the fluid work medium opposed to the direction of movement of the shaping die. However, stretching can also take place in the drawing direction.

For the purpose of more precise profiling of the boundary sections, one embodiment of the invention provides that the profiling elements of the reservoir are shifted when they are pressed by the profiling elements The movement of the shaping die during external high pressure punching and/or during pressing of the boundary sections can be controlled or regulated dependent on force, direction or speed. .

BRIEF DESCRIPTION OF THE FIGURES

The invention is described below in detail on the basis of the drawings schematically showing various phases during forming.

DETAILED DESCRIPTION OF THE FIGURES

Figure 1:
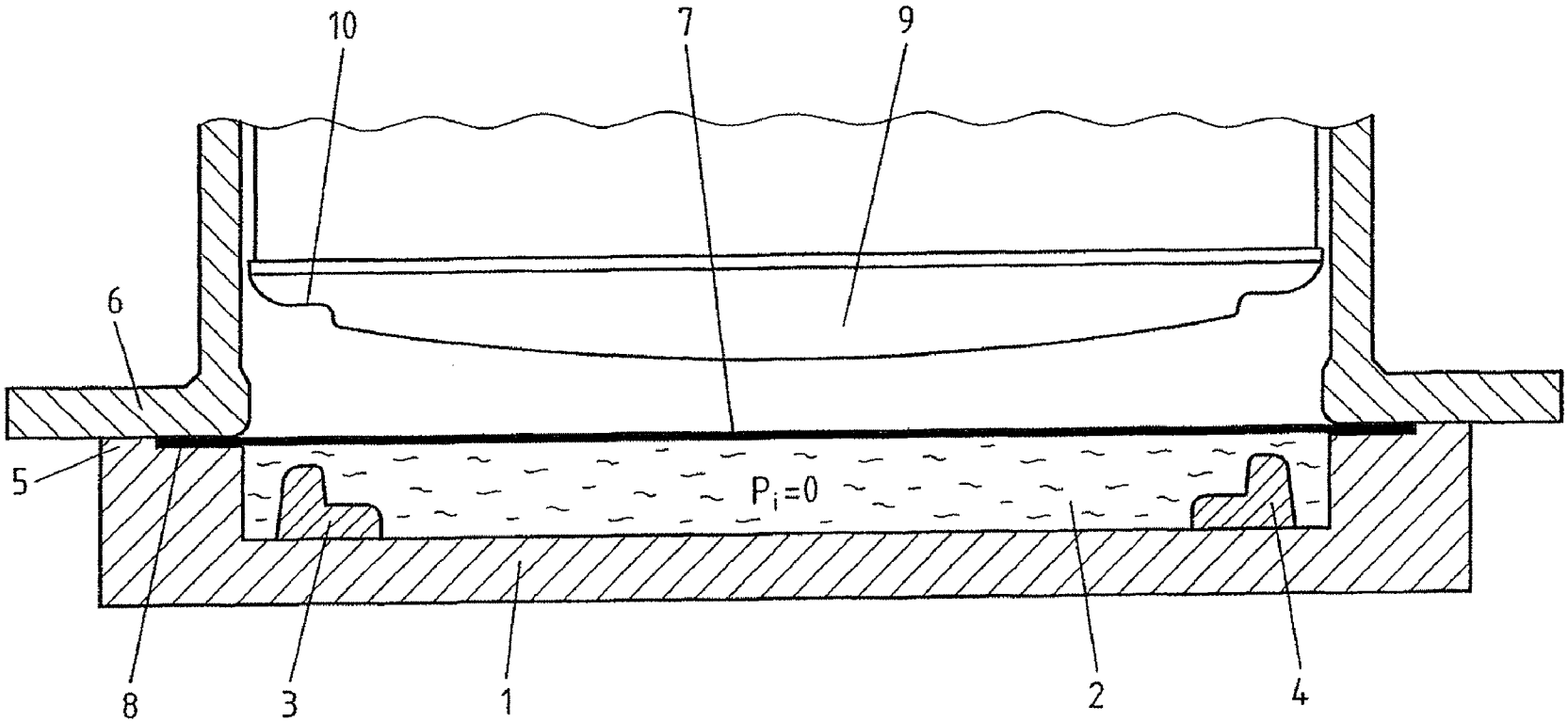
FIG. 1 illustrates a molding tool, according to an illustrative embodiment of the invention.

The molding tool illustrated in the drawings comprises a dish-shaped reservoir 1, which is filled to its top level with water 2 as incompressible medium. Profiling elements 3, 4, which can be arranged rigidly but also controllably, are located on the base of the reservoir 1. The top edge of the reservoir 1 is designed as a jaw 5. A mobile jaw 6 is associated with this jaw 5. A flat metal plate 7 rests on the jaw 5 and on the level of the fluid work medium 2. The outside boundary section 8 of the metal plate 7 is tightly clamped between the clamping jaws 5, 6, so that the fluid work medium 2 cannot escape from the reservoir 1. As FIG. 1 shows, the internal pressure of the water is Pi=0.

Figure 2:
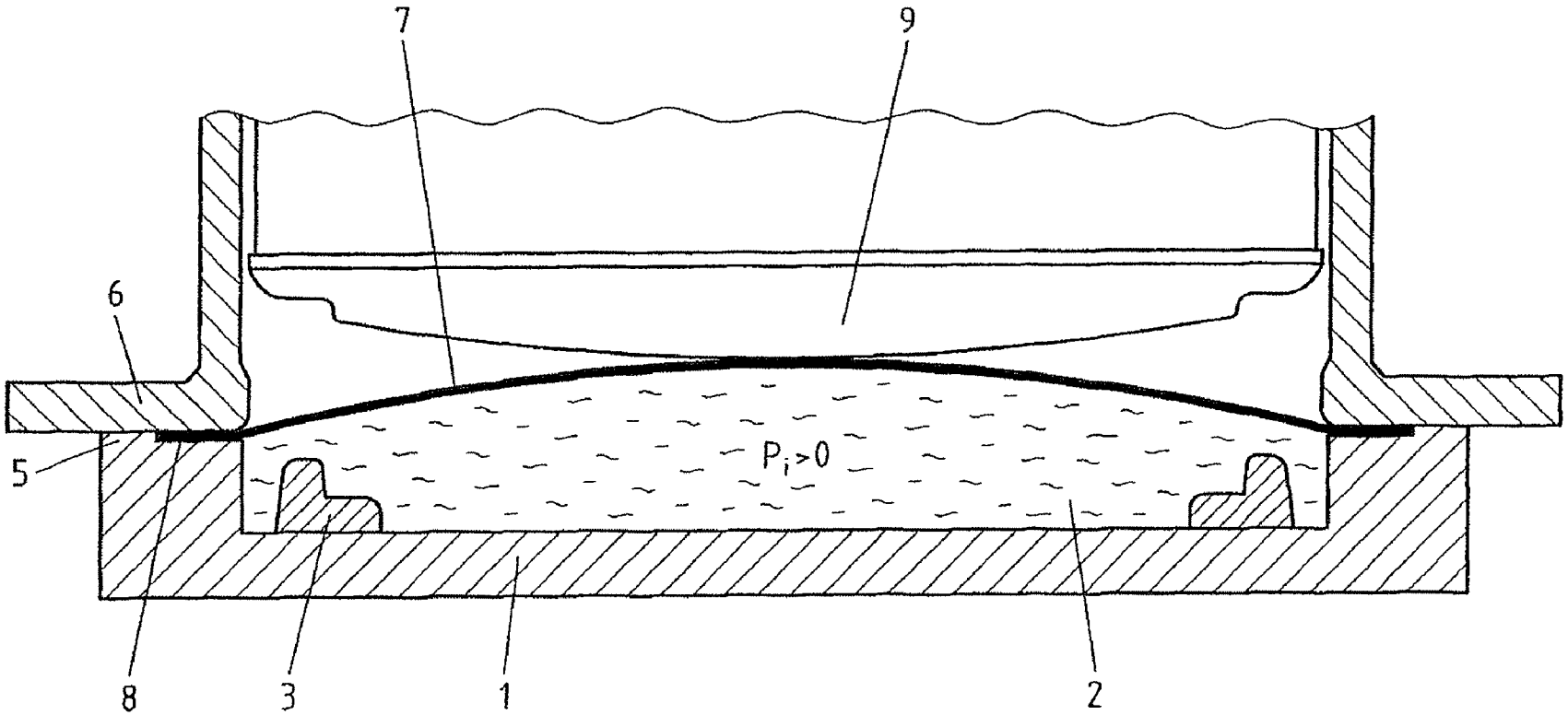
FIG. 2 illustrates pre-stretching of the flat metal plate, according to an illustrative embodiment of the invention.

In order to pre-stretch the flat metal plate 7, the fluid work medium 2 can be pressurized. In FIG. 2 it is clear that when pressure Pi>0 is applied the metal plate 7 bends upwards.

Figure 3:
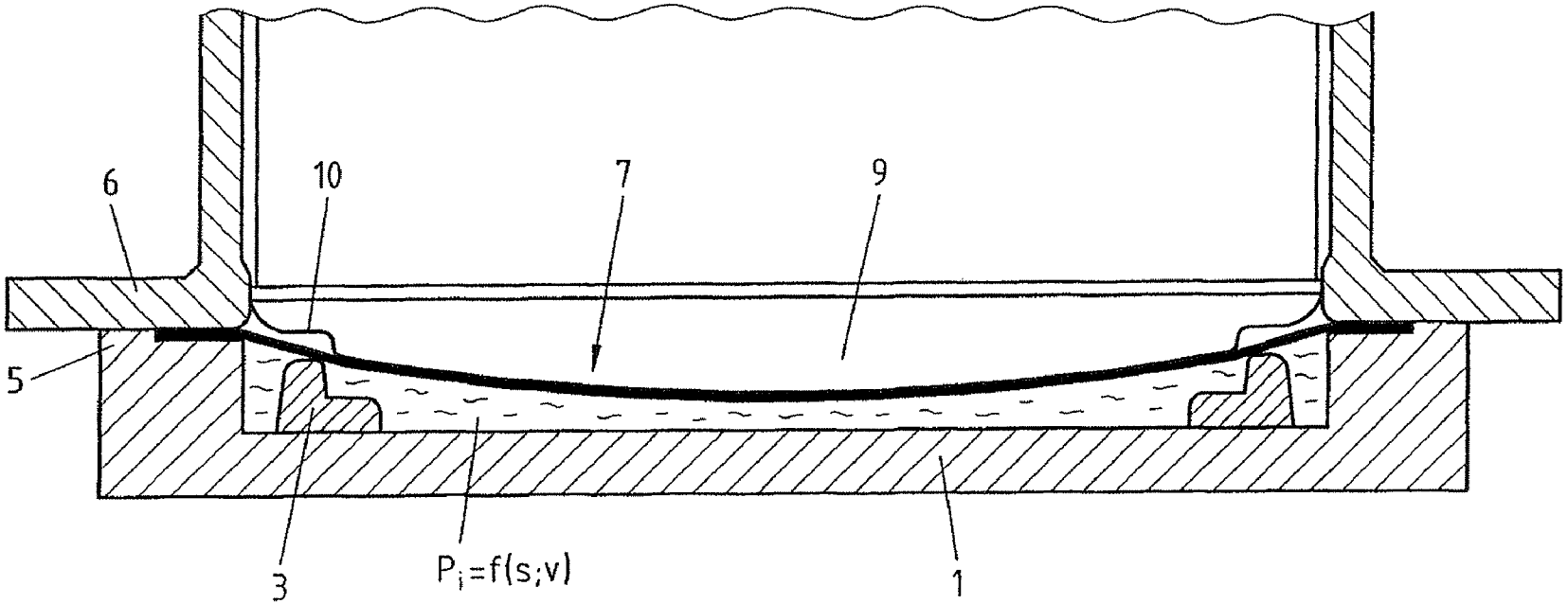
FIG. 3 illustrates external high pressure punching, according to an illustrative embodiment of the invention.

The molding tool has a shaping die 9, on which profiling elements 10 are configured. For external high pressure punching, the stamping die 9 is moved towards the plate 7. The pressure Pi of the fluid work medium 2 in the reservoir can then be controlled accordingly following a given curve. The counter-pressure Pi must be so great in each case that the metal plate 7, at least in the central section 7*a*, is pressed firmly against the shaping die 9. As soon as the shaping die 9 has reached the profiling elements 3, 4, the pressure Pi is reduced, possibly even to zero. This phase is shown in FIG. 3.

Figure 4:
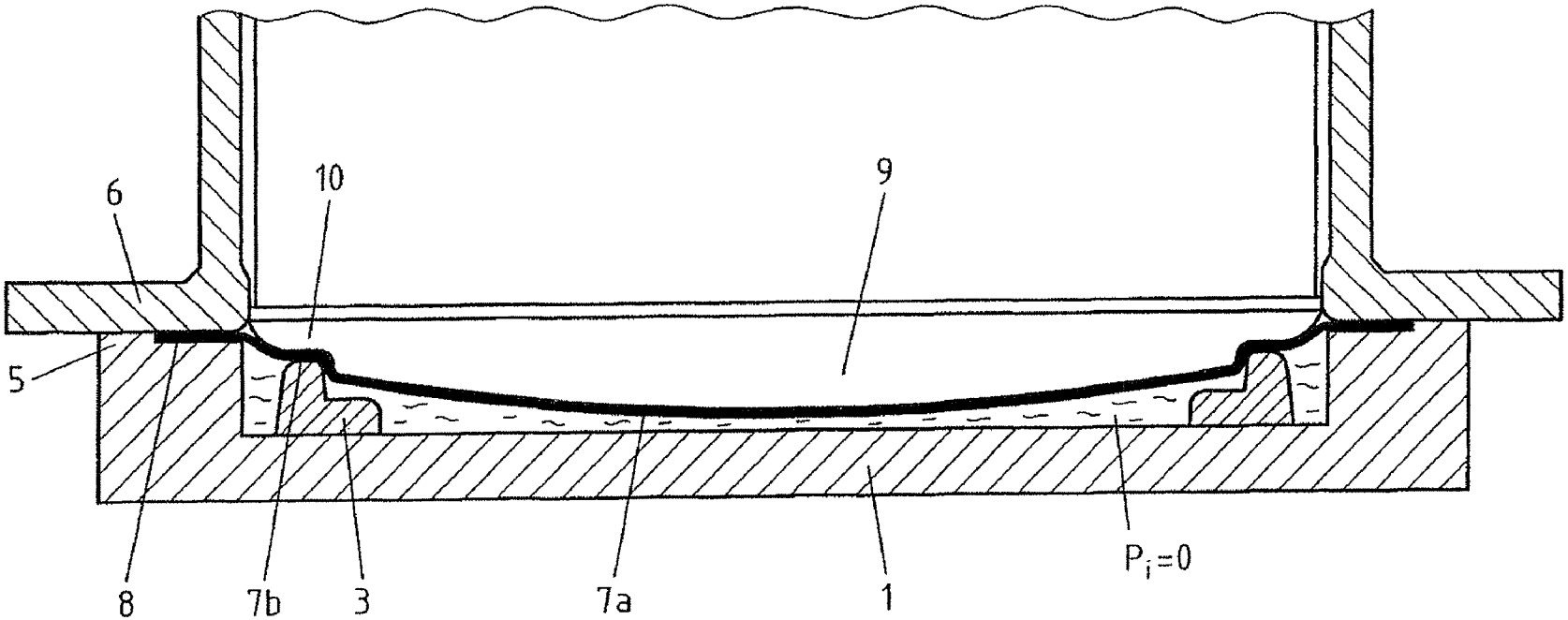
FIG. 4 illustrates a profiling phase of the boundary section, according to an illustrative embodiment of the invention.

Subsequent to this phase of external high pressure-forming/hydro-mechanical deep-drawing, in which forming of the central section 7*a* of the parts essentially takes place and this is completed before the end of this phase, the profiling phase of the boundary section 7*b* directly adjacent to the central section 7*a* follows on. For this purpose, the clamping force of the clamping jaws 5, 6 is firstly reduced. The boundary section 7*b* is profiled during the further forward movement of the shaping die 9, by being pressed between the profiling elements 3 of the reservoir 1 and 10 of the shaping die 9. This phase is shown in FIG. 4.

After the shaped part obtained from the metal plate is removed it is finished by shearing off the boundary section 8 used for clamping.

The invention claimed is:

1. A process for forming a large-surface metal plate into a shaped part having a central section and a boundary section, the process comprising the steps of:

forming the central section by external high pressure punching; and forming the boundary section by pressing with a greater degree of deformation compared to a degree of deformation of the central section, using a molding tool having a reservoir filled with incompressible fluid work medium and having profiling elements, arranged therein for the boundary section of metal plate clamping jaws for tight clamping of the metal plate in an outside boundary section at the edge of the reservoir and a shaping die, movable towards the reservoir and having at an outer edge configured profiling elements corresponding to the profiling elements of the reservoir, wherein the external high pressure punching by the shaping die moving forward against the pressure of the fluid work medium is ended, when the shaping die reaches the profiling elements in the reservoir, by the pressure of the fluid work medium in the reservoir being reduced, and wherein the boundary section of the metal plate is formed between the profiling elements of the shaping die and the reservoir pressing against each other at a pressure of the fluid work medium that is lower relative to the pressure of the fluid work medium when the central section is formed, or at zero pressure.

2. The process according to claim 1, further comprising relaxing clamping of the outside boundary section of the metal plate, so that material can re-flow towards the profiling elements during the forming of the boundary section.

3. The process according to claim 1, further comprising pre-stretching, during external high pressure punching, the clamped metal plate before the external high pressure punching by the fluid work medium opposed to the direction of movement of the shaping die.

4. The process according to claim 1, further comprising shifting the profiling elements of the reservoir when the boundary section of the metal plate is formed between the profiling elements.

5. The process according to claim 1, further comprising controlling the movement of the shaping die dependent on force, direction or speed.

* * * * *